US007337740B2

(12) United States Patent
Lehmann et al.

(10) Patent No.: US 7,337,740 B2
(45) Date of Patent: Mar. 4, 2008

(54) HIGH LOAD BALANCED RUDDER

(75) Inventors: Dirk Lehmann, Winsen (DE); Björn Walther, Rostock (DE)

(73) Assignee: IBMV Maritime Innovationsgesellschaft mbH, Rostock (DE)

( * ) Notice: Subject to any disclaimer, the term of this patent is extended or adjusted under 35 U.S.C. 154(b) by 0 days.

(21) Appl. No.: 11/299,350

(22) Filed: Dec. 10, 2005

(65) Prior Publication Data

US 2007/0113770 A1 May 24, 2007

(30) Foreign Application Priority Data

Nov. 18, 2005 (DE) ..... 20 2005 018 180 U

(51) Int. Cl.
*B63H 25/06* (2006.01)

(52) U.S. Cl. ..... 114/162

(58) Field of Classification Search ..... 114/162, 114/163, 166, 167

See application file for complete search history.

(56) References Cited

U.S. PATENT DOCUMENTS

| | | | | |
|---|---|---|---|---|
| 3,230,920 A * | 1/1966 | Piskorz-Nalecki | ..... | 114/162 |
| 4,284,025 A * | 8/1981 | Eckhard | ..... | 114/163 |
| 4,653,418 A * | 3/1987 | Mori et al. | ..... | 114/162 |
| 5,231,947 A * | 8/1993 | Kasahara et al. | ..... | 114/162 |

FOREIGN PATENT DOCUMENTS

| | | |
|---|---|---|
| DE | 198 41 392 | 3/2000 |
| JP | 08-072797 | 3/1996 |
| JP | 2001-219897 | 8/2001 |
| JP | 2002-284095 | 10/2002 |
| JP | 2005-247122 | 9/2005 |
| WO | WO 97/11878 | 4/1997 |

* cited by examiner

*Primary Examiner*—Lars A. Olson
(74) *Attorney, Agent, or Firm*—Friedrich Kueffner

(57) ABSTRACT

It is proposed in order to create a high load balanced rudder (100) with a rudder blade (10), whereby the rudder blade (10) is rotatable over a rudder post (11) and the rudder post (11) is placed in a rudder port (12) and the rudder port (12) is supported over a fixed leading head (14) on a hull (13) of the ship which has a reduced flow resistance that a lower edge (15) of the leading head (14) is placed in a diameter area (D) of a driving propeller (17) and a lower rudder port bearing (18) is configured reinforced (19).

3 Claims, 2 Drawing Sheets

HIGH LOAD BALANCED RUDDER

The invention relates to a high load balanced rudder for ships with a rudder blade, whereby the rudder blade is rotatable over a rudder post and the rudder post is placed in a rudder port and the rudder port is supported over a fixed leading head on the hull of the ship.

With rudders, the direction of motion of a ship can be influenced in the wished manner. To this, semi-balanced, partially balanced and fully balanced rudders are known to the skilled in the art for shipbuilding or to the shipbuilding engineer. This being, the rudder blade is fixedly connected with a rudder post which penetrates into the inside of the hull of a ship and which is twisted with the aid of a steering gear in a way known in itself in order to give to the rudder blade the wished angle of incidence with respect to the hull of the ship. This being, the rudder blade is placed under the hull of the ship in such a manner that it is flowed by a propeller downflow of the propeller to drive the ship.

When the rudder blade is in a set position, in particular for high ship speeds, big efforts appear which act onto the rudder blade. In order to absorb them better and to be able to induce them into the hull of the ship, it is known for semi-balanced or partially balanced rudders to fix the proper rudder blade for example over a rudder pintle to a rudder support.

To this, the document DE 198 41 392 A1 discloses a high load balanced rudder for which the rudder blade is positioned with its rudder post in a rudder support hollow column. An additional fixed leading head serves for the support of the rudder support hollow column, leading head which is placed before the rudder support hollow column, this being seen in the direction of motion, and over which this column is connected with the hull of the ship. Thus, the forces and loads appearing with the incidence of the rudder blade can be better induced into the hull of the ship over this leading head so that in particular the construction of the rudder support hollow column must be designed of less massive type. Here the leading head is configured such that its lower edge is always situated above the propeller downflow. It is thus achieved that the lower part of the rotatable rudder blade is completely flown by the propeller downflow and thus the surface available for changing the direction is maximized.

This dimensioning of the leading head can however result in that still high forces and loads act onto the rudder blade so that the rudder blade must have a bigger cross-section for stability reasons and consequently the leading head must also be dimensioned sufficiently big so that the flow resistance of this high load balanced rudder is increased, which is not desired.

Thus, the aim of the invention is to create a high load balanced rudder which has a reduced flow resistance and which has however a sufficient stability.

This aim is achieved by the characteristics indicated in claim 1.

As core idea of this very invention, a leading head known in itself of a high load balanced rudder is extended downwards, this being seen in the vertical direction, so that it penetrates in particular into the propeller downflow of the propeller placed in front of the rudder, this being seen in the direction of motion. This means that the lower edge of the leading head or its lower surface is positioned within a diameter range of the driving propeller of the ship. Thus, the leading head is at least partially flown by the propeller and the surface of the rudder blade which is loaded directly by the propeller downflow is reduced accordingly. Furthermore, a lower rudder port bearing with which the rudder post is positioned rotatable in the rudder port, is configured reinforced in order to be able to better absorb the forces and loads acting onto the rudder blade and to induce them over the rudder port into the hull of the ship. This being, the reinforcement, i.e. the dimensioning as well as the design of this rudder port bearing is to be designed by the skilled in the art according to technical parameters.

The advantage of the invention consists in that, due to the configuration extended downwards of the leading head, the lower rudder port bearing can also be directly supported on the extended leading head or is adjoining to this so that the forces acting onto the lower rudder port bearing are diverted immediately over the structure of the leading head into the hull of the ship. Thus, the forces and loads of the rudder are absorbed more effectively or fully absorbed by the leading head. Thus, the profile or the cross-section surface of the rudder blade—this being seen as a top view—can be reduced since the rudder blade must absorb less forces than in the prior art. In particular the flow resistance of the rudder is thus reduced. A rudder configured in this manner is particularly appropriate for slow-speed ships with a high total weight such as, for example, tankers or bulkers.

Advantageous configurations of the invention are characterized in the subclaims.

With the dimensioning of the leading head indicated in claim 2, it is guaranteed that on the one hand the leading head is extended sufficiently far downwards so that the forces and loads can be sufficiently absorbed over the reinforced lower rudder port bearing and on the other hand the flown fixed surface of the leading head which penetrates into the propeller downflow is dimensioned in such a manner that a satisfactory maneuverability of the ship is guaranteed.

It is clear to the skilled in the art that the high load balanced rudder which is described here can be equipped with an additional rudder fin as indicated in claim 3 in order to be able to use smaller rudder angles in particular for small course corrections or for the course support. The actuation of the rudder fin can take place in connection with the rudder blade in a manner known in itself.

Furthermore, it is proposed in claim 4 that the profiles of the leading head as well as of the rudder blade of the high load balanced rudder are adapted to each other so that there does not appear here any unnecessary swirl in particular at the junction of the leading head with the rudder blade and that the flow resistance of the whole high load balanced rudder is as low as possible.

An embodiment is characterized in claim 5 for which the reinforcement of the lower rudder port bearing can be designed with a different thickness, this being seen in axial direction of the rudder post, in order to obtain here an optimal adaptation to the effectively most favourable leading head structure and to the leading head profile for a material using as low as possible. This being, the dimension or dimensioning of the reinforcement can be configured increasing or decreasing from the top to the bottom. In any case, the port tube and the bearing housing are integrated into the leading head.

Two embodiments of the invention are explained in more detail below by means of the attached drawings.

Figure 1:
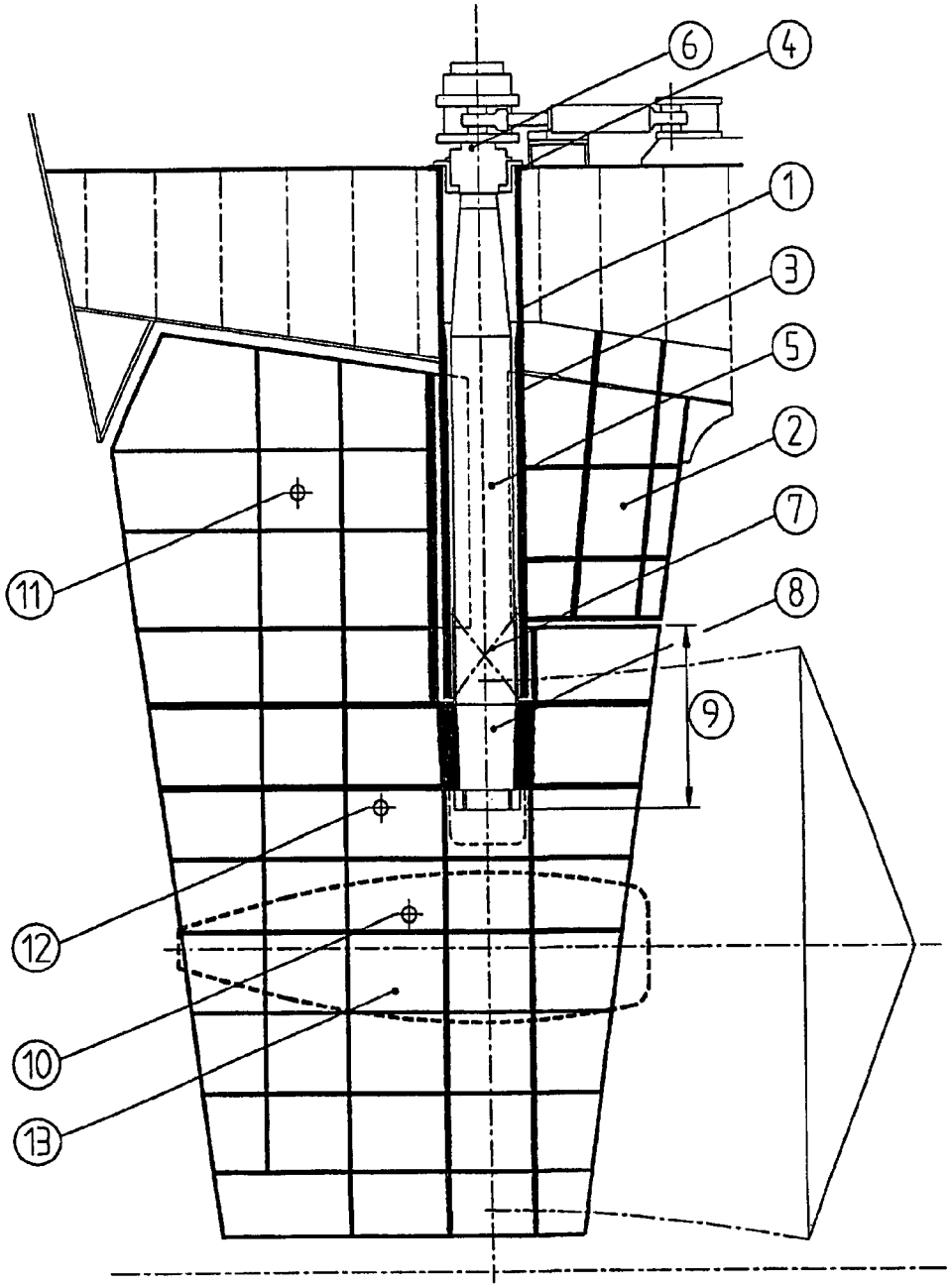
FIG. 1 shows a high load balanced rudder in cross-section.
Figure 2:
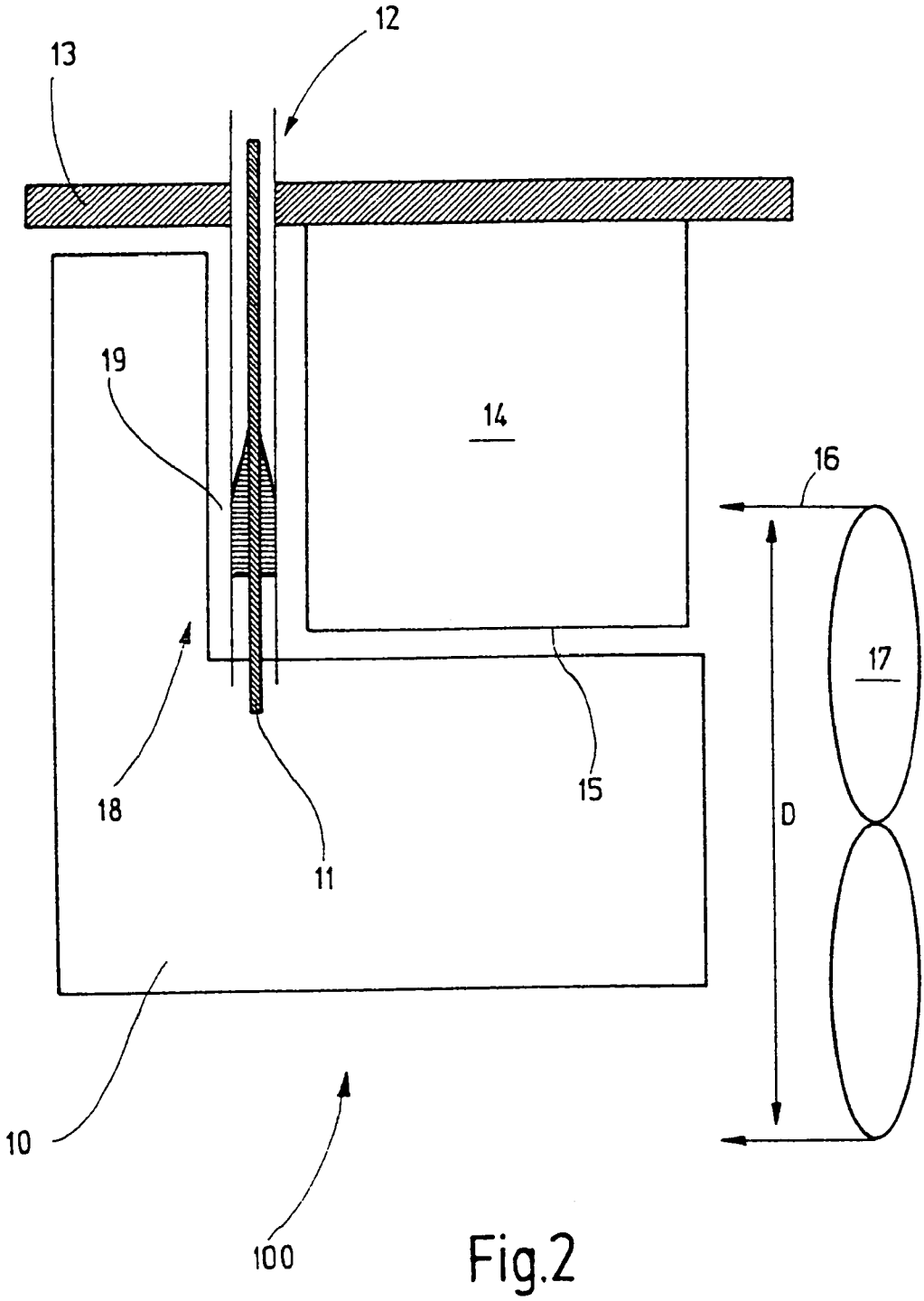
FIG. 2 shows a further high load balanced rudder in cross section.

The basic structure of a high load balanced rudder 100 is schematically represented in FIG. 1 and 2. The high load balanced rudder 100 comprises a rudder blade 10 which is fixedly connected with a rudder post 11. The rudder post 11 is positioned twistable in a rudder port 12 or in a rudder support hollow column. This being, the rudder port 12 is fixedly connected with the hull 13 of the ship. A steering gear which is not represented here for simplifying the representation serves for actuating the rudder blade 10 in a manner known in itself.

A leading head 14 fixedly connected with the hull 13 is additionally provided, the lower edge 15 of which or a lower surface penetrating downwards, this being seen in the vertical direction, as far as this lower edge 15 penetrates into the propeller downflow 16 of a driving propeller 17 with the diameter D of the ship.

Furthermore, a lower rudder port bearing 18 of the rudder post 11 is configured reinforced, as it is indicated here schematically with the reinforcements 19.

Due to the extended embodiment of the leading head 14, the lower rudder port bearing 18 can be positioned in such a way that it is situated with the leading head 14 or with its lower edge 15 at the same level so that by an incidence of the rudder blade 10 the forces and loads acting thereon can be derived over the reinforcements 19 directly into the leading head 14 and thus into the hull 13 of the ship. Preferably the leading head 14 penetrates into a range between 10% to 20% of the diameter D of the propeller downflow 16.

For the configuration of the reinforcement 19, it is proposed that this reinforcement increases in its diameter either from the top to the bottom, this being seen in axial direction of the rudder post, as represented in FIG. 1, or decreases as represented in FIG. 2. Thus, an optimal dimensioning is possible to the forces which effectively act onto the lower rudder port bearing 18 and no superfluous material is needed for realizing the reinforcements.

LIST OF REFERENCE NUMERALS

100 High load balanced rudder
10 Rudder blade
11 Rudder post
12 Rudder port
13 Hull of the ship
14 Leading head
15 Lower edge
16 Propeller downflow
17 Propeller
18 Lower rudder port bearing
19 Reinforcement
D Diameter of the propeller

The invention claimed is:

1. High load balanced rudder (100) for ships with a drive propeller (17) and a rudder blade (10), wherein the rudder blade (10) is rotatable by a rudder post (11) and the rudder post (11) is placed in a rudder port (12) and the rudder port (12) is supported over a fixed leading head (14) on a hull (13) of the ship, wherein a lower edge (15) of the leading head (14) protrudes into the propeller downflow into a range of 10% to 20% of the propeller diameter (D) and a lower rudder port bearing (18) is configured with a reinforcement (19), wherein the reinforcement (19) of the lower rudder port bearing (18) has different thicknesses axially relative to the rudder post (11), wherein dimensioning of the reinforcement increases or decreases in the axial direction of the rudder post (11) from top to bottom, and wherein the lower rudder port bearing (18) is arranged along its entire length directly next to the leading head (14) so that the lower rudder port bearing (18) is at a common height with the leading head (14).

2. High load balanced rudder according to claim 1, wherein an additional rudder fin is provided on the rudder blade (10).

3. High load balanced rudder according to claim 1, wherein a profile of the rudder blade (10) as well as a profile of the leading head (14) are adapted to each other for reducing the flow resistance.

* * * * *

UNITED STATES PATENT AND TRADEMARK OFFICE

CERTIFICATE OF CORRECTION

PATENT NO. : 7,337,740 B2
APPLICATION NO. : 11/299350
DATED : March 4, 2008
INVENTOR(S) : Dirk Lehmann et al.

It is certified that error appears in the above-identified patent and that said Letters Patent is hereby corrected as shown below:

Title Page, Item (73) Assignee should read:

-- (73) Assignee: IBMV Maritime Innovationsgesellschaft mbH
für die gewerbliche Wirtschaft in
Mecklenburg Vorpommern, Rostock (DE) --.

Signed and Sealed this
Ninth Day of July, 2013

Teresa Stanek Rea
*Acting Director of the United States Patent and Trademark Office*